US006916150B2

(12) United States Patent
Liang

(10) Patent No.: US 6,916,150 B2
(45) Date of Patent: Jul. 12, 2005

(54) COOLING SYSTEM FOR A TIP OF A TURBINE BLADE

(75) Inventor: George Liang, Palm City, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 30 days.

(21) Appl. No.: 10/722,972

(22) Filed: Nov. 26, 2003

(65) Prior Publication Data

US 2005/0111979 A1 May 26, 2005

(51) Int. Cl.[7] ..... F01D 5/18
(52) U.S. Cl. ..... 415/115; 416/97 R
(58) Field of Search ..... 415/115; 416/97 R

(56) References Cited

U.S. PATENT DOCUMENTS

| | | | | |
|---|---|---|---|---|
| 3,872,563 A | | 3/1975 | Brown et al. | |
| 4,142,824 A | * | 3/1979 | Andersen | 415/115 |
| 4,221,539 A | | 9/1980 | Corrigan | |
| 4,276,101 A | | 6/1981 | Lyons | |
| 4,411,597 A | | 10/1983 | Koffel et al. | |
| 4,487,550 A | | 12/1984 | Horvath et al. | |
| 4,540,339 A | | 9/1985 | Horvath | |
| 4,589,823 A | | 5/1986 | Koffel | |
| 4,669,957 A | * | 6/1987 | Phillips et al. | 416/97 R |
| 4,682,933 A | * | 7/1987 | Wagner | 415/173.5 |
| 5,264,011 A | | 11/1993 | Brown et al. | |
| 5,403,158 A | * | 4/1995 | Auxier | 416/97 R |
| 5,733,102 A | | 3/1998 | Lee et al. | |
| 6,164,914 A | * | 12/2000 | Correia et al. | 416/97 R |
| 6,231,307 B1 | | 5/2001 | Correia | |
| 6,325,871 B1 | | 12/2001 | Burke et al. | |
| 6,331,217 B1 | | 12/2001 | Burke et al. | |
| 6,461,107 B1 | | 10/2002 | Lee et al. | |
| 6,494,678 B1 | | 12/2002 | Bunker | |
| 6,527,514 B2 | * | 3/2003 | Roeloffs | 416/97 R |
| 6,558,119 B2 | | 5/2003 | Lee et al. | |
| 2002/0141872 A1 | | 10/2002 | Darolia et al. | |
| 2002/0148115 A1 | | 10/2002 | Burke et al. | |

* cited by examiner

*Primary Examiner*—Edward K. Look
*Assistant Examiner*—Igor Kershteyn

(57) ABSTRACT

A turbine blade for a turbine engine having a cooling system in at least the tip portion of the turbine blade. The cooling system includes one or more vortex chambers in a tip section of the blade. The vortex chambers receive cooling fluids from metering slots that provide a pathway between internal cooling cavities of the blade and the vortex chambers. The cooling fluids may be exhausted through one or more film cooling holes. The vortex chambers, metering slots, and film cooling holes may include a tip cap attached to the tip section of the blade. At least a portion of the vortex chambers, metering slots, and film cooling holes may be formed from impressions in the tip cap or the turbine blade, or both.

17 Claims, 4 Drawing Sheets

COOLING SYSTEM FOR A TIP OF A TURBINE BLADE

FIELD OF THE INVENTION

This invention is directed generally to turbine blades, and more particularly to hollow turbine blades having internal cooling channels for passing gases, such as air, to cool the blades.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion at one end and an elongated portion forming a blade that extends outwardly from a platform coupled to the root portion at an opposite end of the turbine blade. The blade is ordinarily composed of a tip opposite the root section, a leading edge, and a trailing edge. The inner aspects of most turbine blades typically contain an intricate maze of cooling channels forming a cooling system. The cooling channels in the blades receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade.

Typically, conventional turbine blades have a plurality of core print out holes at the tip of the blade that are a result of the manufacturing processes commonly used to create a turbine blade. These core print out holes are often welded closed, and a plurality of exhaust orifices are drilled into the pressure and suction sides of a tip section of a turbine blade, as shown in FIGS. 1 and 2, to provide film cooling to the tip region of the turbine blade. The process of welding the core print out holes closed and drilling holes into the blade tips is time consuming and thus, costly. Thus, a need exists for a more efficient manner of manufacturing and cooling a tip of a turbine blade.

In addition, exhaust orifices proximate to a tip of a turbine blade are typically drilled into the outer housing of the turbine blade. Thus, the exhaust orifices are typically straight, which results in the cooling flow distribution and pressure ratio across these cooling holes being dictated by the internal configuration of the cooling system and not the exhaust orifices. The direction and velocity of the fluid flowing through the cooling holes cannot be regulated. Thus, a tip cooling system is needed that enables the cooling flow distribution and velocity of the cooling fluids to be regulated.

SUMMARY OF THE INVENTION

This invention relates to a turbine blade capable of being used in turbine engines and having a turbine blade cooling system for dissipating heat from a tip of the turbine blade. The turbine blade may be a generally elongated blade having a leading edge, a trailing edge, a tip at a first end that is opposite a root for supporting the blade and for coupling the blade to a disc, and an outer wall. The turbine blade may also include at least one cavity forming a cooling system in inner aspects of the blade. The cooling system may include one or more vortex chambers in the tip of the turbine blade. The vortex cooling chambers may receive cooling fluids through one or more metering slots coupling the vortex chambers to the cavity. The turbine blade may also include one or more film cooling slots extending from the vortex chamber to an outer surface of the generally elongated blade for exhausting cooling fluids from the vortex chambers.

The vortex chambers and other components of the cooling system may be formed using one or more tip caps. In at least one embodiment, the vortex chamber, the metering slots, and the film cooling holes may be formed from impressions on an inner surface the tip cap, or on an outer surface of the outer wall, or both. The impressions may be configured so that when the tip cap is attached to the outer wall, the impressions form the vortex chambers, the metering slots, and the film cooling holes.

During operation, cooling gases flow from the root of the blade through inner aspects of a cooling system in the blade. At least a portion of the cooling gases entering the cooling system of the turbine blade through the base passes through the metering slots in the tip of the turbine blade. The cooling fluids may then pass into the vortex chambers, where vortices may be formed. The cooling fluids may receive heat from the turbine blade in the vortex chambers and then be exhausted through the film cooling holes.

An advantage of this invention is that by forming cooling orifices using a tip cap, the necessities of welding core print out holes and drilling cooling orifices are eliminated, thereby reducing manufacturing costs.

Another advantage of this invention is that each metering slot may be sized individually to create a more efficient tip cooling system based upon supply and discharge pressures of the cooling fluids.

Yet another advantage of this invention is that the vortex chambers and other components of the cooling system result in a higher overall blade tip cooling effectiveness of a turbine blade as compared with conventional designs at least because the vortex chambers result in a higher heat transfer convection coefficient of the cooling fluids.

Still another advantage of this invention is that the film cooling holes may be placed in close proximity to the squealer tip, which enables the temperature of the tip to be reduced.

Yet another advantage of this invention is that the blade leakage flow past the end of the turbine blade may be reduced, in part, because the film cooling holes inject cooling air at much closer distances to the blade tip gap than convention designs.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
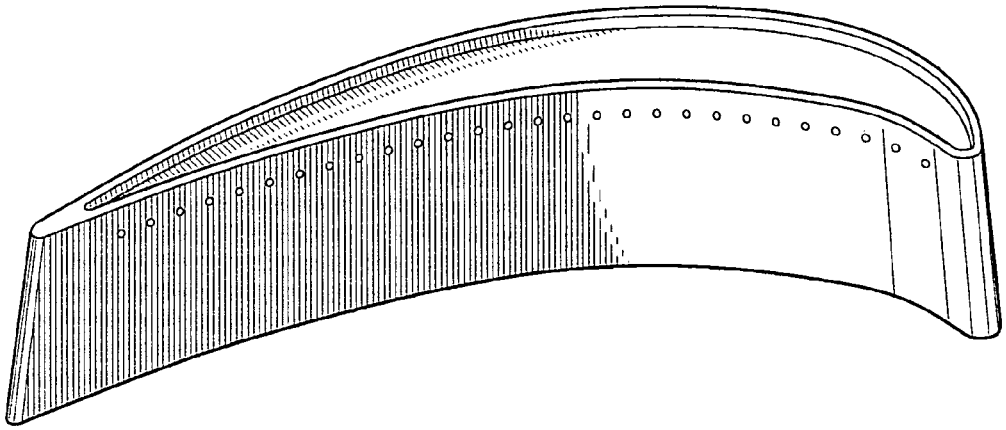
FIG. 1 is a perspective view of a pressure side of a tip section of a convention turbine blade.
Figure 2:
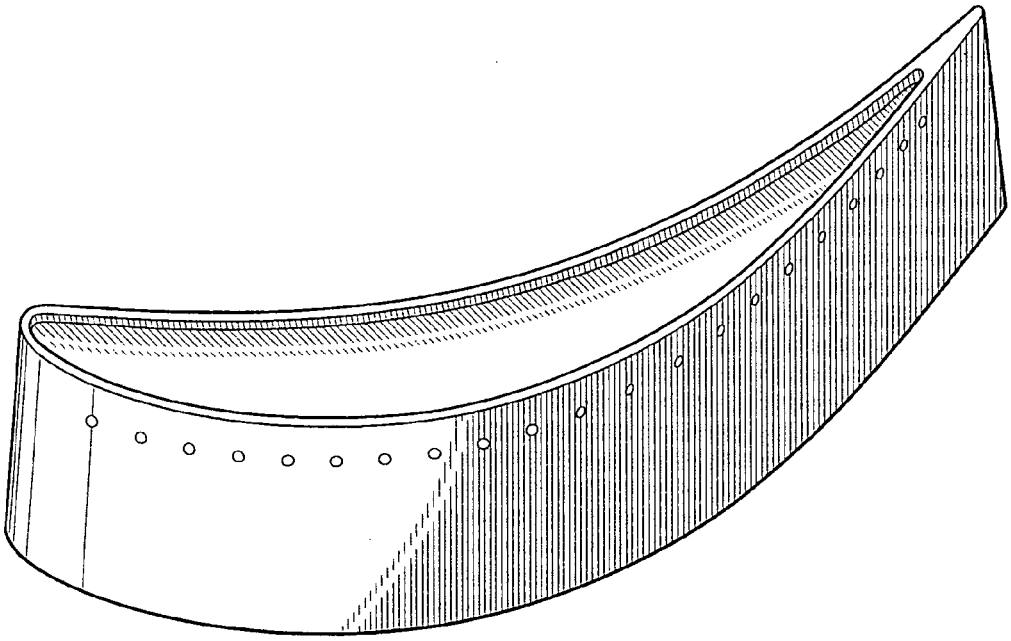
FIG. 2 is a perspective view of a suction side of a tip section of a convention turbine blade.
Figure 3:
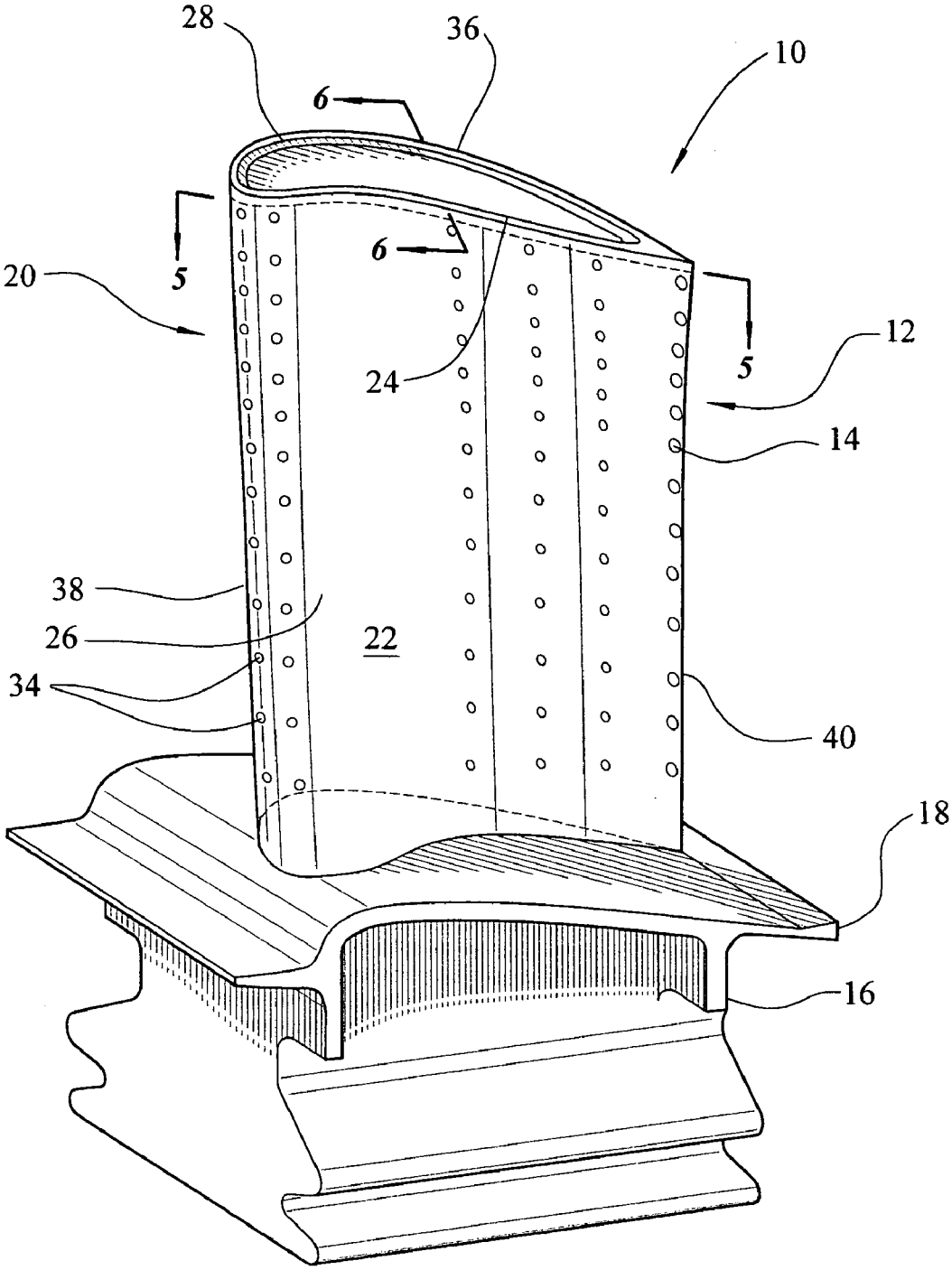
FIG. 3 is a perspective view of a turbine blade having features according to the instant invention.
Figure 4:
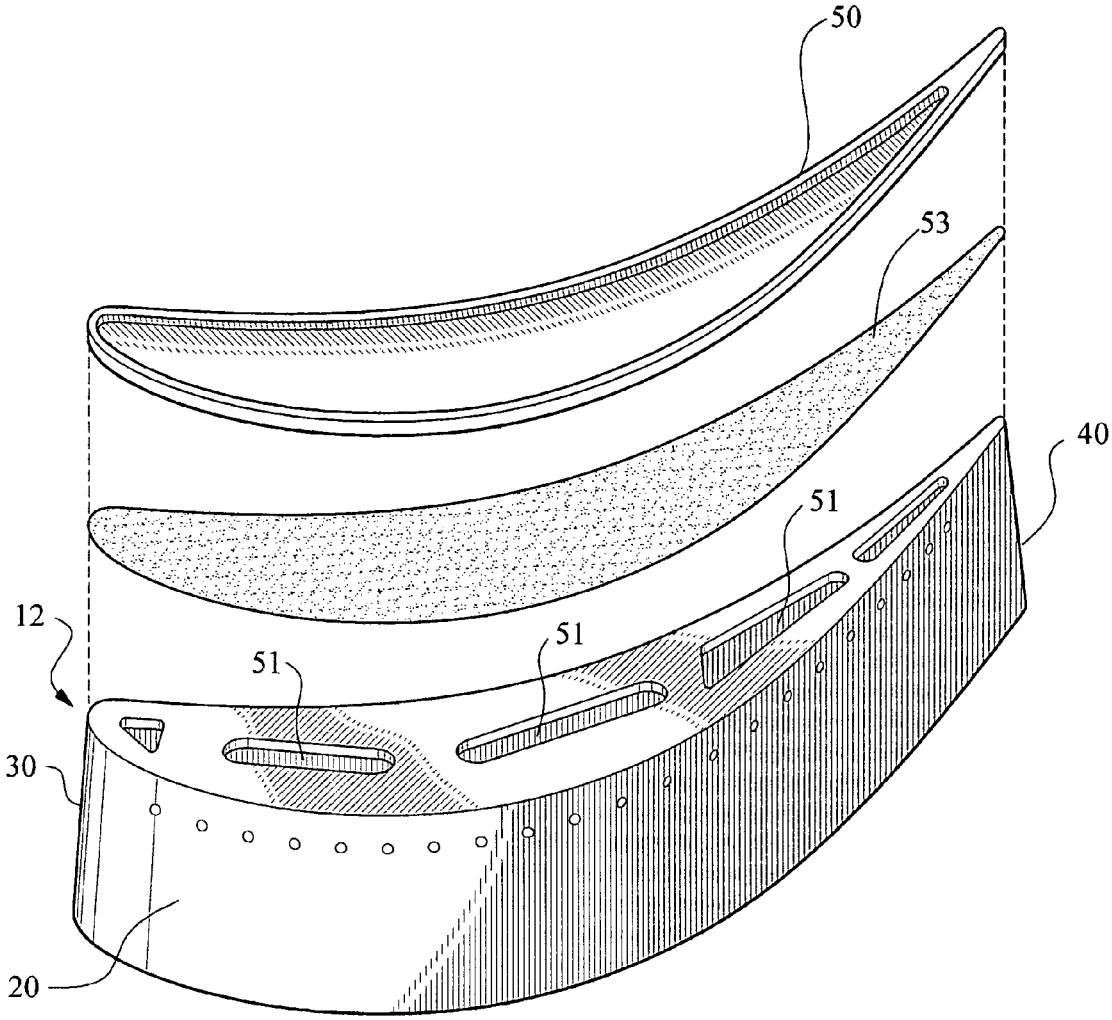
FIG. 4 is an exploded view of the tip cap shown in FIG. 3.
Figure 5:
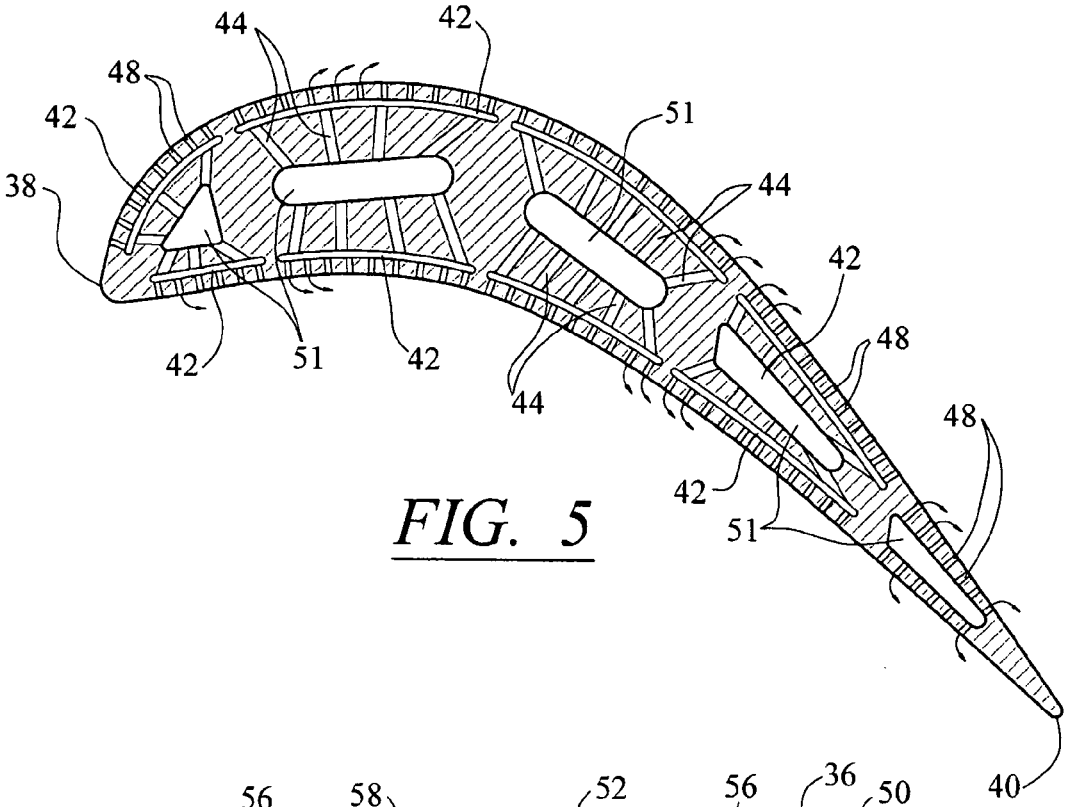
FIG. 5 is a cross-sectional view of the turbine blade taken along line 5—5 in FIG. 3.
Figure 6:
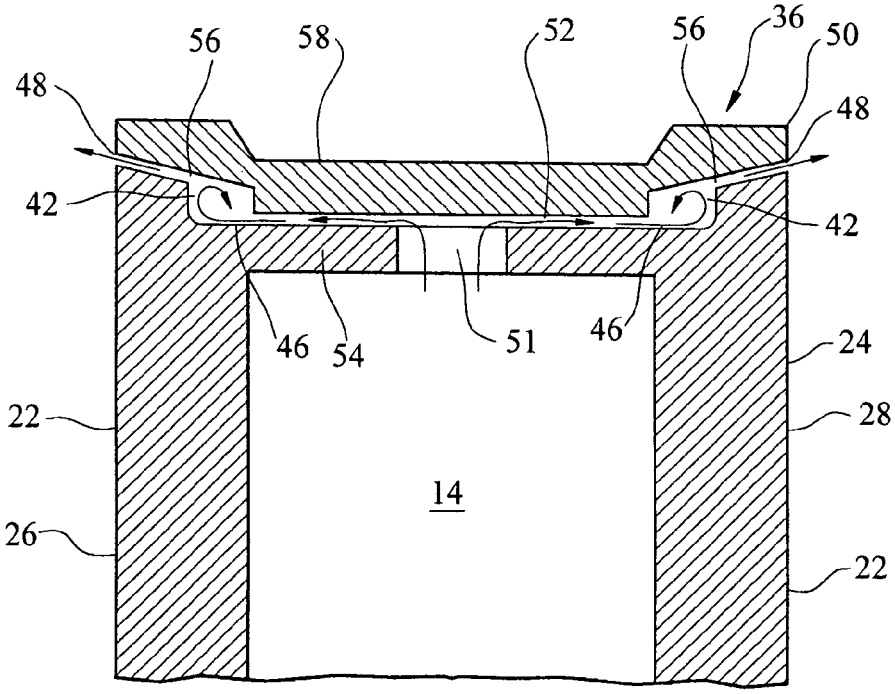
FIG. 6 is a cross-sectional view of the turbine blade taken along line 6—6 in FIG. 3.

As shown in FIGS. 3–6, this invention is directed to a turbine blade cooling system 10 for turbine blades 12 used in turbine engines. In particular, turbine blade cooling system 10 is directed to a cooling system 10 located in a cavity 14, as shown in FIG. 6, positioned between outer walls 22 forming a housing 24 of the turbine blade 12. As shown in FIG. 3, the turbine blade 12 may be formed from a root 16 having a platform 18 and a generally elongated blade 20 coupled to the root 16 at the platform 18. Blade 20 may have an outer wall 22 adapted for use, for example, in a first stage of an axial flow turbine engine. Outer wall 22 may have a generally concave shaped portion forming pressure side 26 and may have a generally convex shaped portion forming suction side 28.

The cavity 14, as shown in FIG. 5, may be positioned in inner aspects of the blade 20 for directing one or more gases, which may include air received from a compressor (not shown), through the blade 20 and out one or more orifices 34 in the blade 20. As shown in FIG. 3, the orifices 34 may be positioned in a leading edge 38 or a trailing edge 40, or any combination thereof, and have various configurations. The orifices 34 provide a pathway from the cavity 14 through the outer wall 22. The cavity 14 may be have one or a plurality of cavities and is not limited to a particular configuration for purposes of this invention. The cavity 14 may have various configurations capable of passing a sufficient amount of cooling gases through the elongated blade 20 to cool the blade 20.

The turbine blade cooling system 10 may also include one or more vortex chambers 42 in a tip 36 of the turbine blade 12. The tip 36 may be a portion of the blade 12 opposite the root 16. In at least one embodiment, as shown in FIG. 5, the turbine blade cooling system 10 may include a plurality of vortex chambers 42 positioned across a cross-sectional area of the blade 20. The vortex chamber 42 may be fed with cooling fluids from the cavity 14 through metering slots 44 and exhausted through film cooling holes 48 extending between a vortex chamber 42 and an outer surface of the generally elongated blade 20. Each vortex chamber 42 may be fed with cooling fluids through one or more metering slots 44. The metering slots 44 may be sized individually to control flow of the fluids through the vortex chambers 42 and the metering slots 44 depending on the configuration of the blade 20. The metering slots 44 may be attached to a vortex chamber 42 so as to create a vortex in the vortex chamber 42. This may be accomplished in more than one manner. In at least one embodiment, the metering slots 44 may be coupled to a vortex chamber 42 at a bottom surface 46 of the vortex chamber 42, as shown in FIG. 6. The vortex chamber 42 may have a generally rectangular cross-section with a pointed outer corner 56. The pointed outer corner 56 may be formed from sides at an angle of less than about 90 degrees relative to each other. The film cooling holes 48 may be attached to the pointed outer corner 56 of the vortex chamber 42.

In at least one embodiment, the turbine blade cooling system 10 may also include a tip cap 50 forming the tip 36 of the turbine blade 12. The tip cap 50 may be attached to the turbine blade 12 using a transient liquid phase bonding technique (TLP) or other suitable method. An adhesive layer 53 may be used to adhere the tip cap 50 to the turbine blade 12. The tip cap 50 may seal core print out holes 51, as shown in FIG. 4. The tip cap 50 may be subjected to heat treatment, blending, and machining to produce an appropriate connection between the tip cap 50 and the elongated blade 20. In at least one embodiment, the vortex chamber 42 may be positioned between the tip cap 44 and an outer wall 22 of the turbine blade 12. More specifically, the vortex chambers 42, the metering slots 44, and the film cooling holes 48 may be formed from impressions in an inner surface 52 of the tip cap 50, an outer surface 54 of the outer wall 22 of the turbine blade, or a combination of impressions in the inner and outer surfaces 52, 54. The impressions may be formed on these surfaces such that when they are coupled together, the vortex chamber 42, the metering slots 44, or the film cooling holes 48 may be formed, of any combination thereof. In at least one embodiment, the turbine blade 12 may also include a squealer pocket 58 at the tip 36.

In operation, cooling fluids, such as, but not limited to, air, flows through the root 16 of the turbine blade 12 and into the cavity 14. The cooling fluids then flow through the cavity and pass through the outer wall 22 via orifices 34 in the elongated blade 20 and the core printout holes 51. The cooling fluids pass through the core printout holes and into the metering slots 44. The cooling fluids passing into the metering slots 44 are passed into the vortex chambers 42, where vortices may be formed. The cooling fluids receive heat from the materials forming the tip 36 of the elongated blade 20 and may be exhausted from the vortex chamber 42 through the film cooling holes 48. At least a portion of the cooling fluids then flow in close proximity of the tip 36 and keep the temperature of the tip 36 within an operable range.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine blade, comprising:

a generally elongated blade having a leading edge, a trailing edge, and a tip at a first end, a root coupled to the blade at an end generally opposite the first end for supporting the blade and for coupling the blade to a disc, at least one cavity forming a cooling system in the blade, and at least one outer wall defining the at least one cavity forming at least a portion of the cooling system;

wherein the cooling system comprises at least one orifice in the tip of the generally elongated blade providing a pathway from the at least one cavity forming at least a portion of the cooling system through the at least one outer wall;

at least one vortex chamber in the tip of the generally elongated blade;

a plurality of metering slots extending between the at least one orifice and the at least one vortex chamber; and at least one film cooling hole extending from the at least one vortex chamber to an outer surface of the generally elongated blade.

2. The turbine blade of claim 1, further comprising a tip cap adapted to be coupled to the tip of the generally elongated blade.

3. The turbine blade of claim 2, where at least a portion of the at least one vortex chamber, the plurality of metering slots, and the at least one film cooling hole are positioned between an inner surface of the tip cap and an outer surface of at least one outer wall.

4. The turbine blade of claim 2, wherein the tip cap comprises at least one squealer pocket on an outer surface of the tip cap.

5. The turbine blade of claim 1, wherein the at least one vortex chamber comprises a plurality of laterally extending vortex chambers positioned between the at least one orifice and the at least one outer wall.

6. The turbine blade of claim 1, wherein the at least one orifice comprises a plurality of orifices, wherein each orifice has at least one metering slot extending between the orifice and a vortex chamber proximate to the orifice.

7. The turbine blade of claim 6, wherein the at least one vortex chamber comprises a plurality of laterally extending vortex chambers, wherein each orifice has at least one vortex chamber positioned proximate to the orifice and positioned between the orifice and an outer surface of the generally elongated blade.

8. The turbine blade of claim 1, wherein the at least one vortex chamber has a generally rectangular cross-section with an outer corner, diagonal from a point at which a metering slot is attached, having an inside angle less than about 90 degrees.

9. The turbine blade of claim 8, wherein the at least one film cooling hole is coupled to the at least one vortex chamber at the outer corner.

10. A turbine blade, comprising:

a generally elongated blade having a leading edge, a trailing edge, and a tip at a first end, a root coupled to the blade at an end generally opposite the first end for supporting the blade and for coupling the blade to a disc, at least one cavity forming a cooling system in the blade, and at least one outer wall defining the at least one cavity forming at least a portion of the cooling system;

wherein the cooling system comprises at least one orifice in the tip of the generally elongated blade providing a pathway from the at least one cavity forming at least a portion of the cooling system through the at least one outer wall;

at least one vortex chamber in the tip of the generally elongated blade, wherein the at least one vortex chamber has a generally rectangular cross-section with an outer corner, diagonal from a point at which a metering slot is attached, having an inside angle less than about 90 degrees;

a plurality of metering slots extending between the at least one orifice and the at least one vortex chamber; and at least one film cooling hole extending from the at least one vortex chamber to an outer surface of the generally elongated blade.

11. The turbine blade of claim 10, further comprising a tip cap adapted to be coupled to the tip of the generally elongated blade.

12. The turbine blade of claim 11, wherein the at least one vortex chamber, the plurality of metering slots, and the at least one film cooling hole are positioned between an inner surface of the tip cap and an outer surface of at least one outer wall.

13. The turbine blade of claim 11, wherein the tip cap comprises at least one squealer pocket on an outer surface of the tip cap.

14. The turbine blade of claim 10, wherein the at least one vortex chamber comprises a plurality of laterally extending vortex chambers positioned between the at least one orifice and the at least one outer wall.

15. The turbine blade of claim 10, wherein the at least one orifice comprises a plurality of orifices, wherein each orifice has at least one metering slot extending between the orifice and a vortex chamber proximate to the orifice.

16. The turbine blade of claim 15, wherein the at least one vortex chamber comprises a plurality of laterally extending vortex chambers, wherein each orifice has at least one vortex chamber positioned proximate to the orifice and positioned between the orifice and an outer surface of the generally elongated blade.

17. The turbine blade of claim 10, wherein the at least one film cooling hole is coupled to the at least one vortex chamber at the outer corner.

* * * * *